US010364110B2

(12) United States Patent
Schalk et al.

(10) Patent No.: US 10,364,110 B2
(45) Date of Patent: Jul. 30, 2019

(54) MEDIA TRANSPORT JAM PREVENTION

(71) Applicant: Hewlett-Packard Development Company, L.P., Houston, TX (US)

(72) Inventors: Wesley R. Schalk, Camas, WA (US); Jeffrey G. Bingham, Vancouver, WA (US); Justin M. Roman, Portland, OR (US); Andrew T. Davis, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/570,225

(22) PCT Filed: May 15, 2015

(86) PCT No.: PCT/US2015/031158
§ 371 (c)(1),
(2) Date: Oct. 27, 2017

(87) PCT Pub. No.: WO2016/186622
PCT Pub. Date: Nov. 24, 2016

(65) Prior Publication Data

US 2018/0118489 A1 May 3, 2018

(51) Int. Cl.

| | |
|---|---|
| ***B65H 7/06*** | (2006.01) |
| ***B65H 7/08*** | (2006.01) |
| ***B65H 7/20*** | (2006.01) |
| ***B65H 3/06*** | (2006.01) |
| ***B65H 7/18*** | (2006.01) |
| ***B65H 29/20*** | (2006.01) |

(52) U.S. Cl.
CPC ..... *B65H 7/06* (2013.01); *B65H 3/06* (2013.01); *B65H 7/08* (2013.01); *B65H 7/18* (2013.01);
(Continued)

(58) Field of Classification Search
CPC ... B65H 7/08; B65H 7/06; B65H 7/18; B65H 7/20; B65H 2511/12; B65H 2511/528;
(Continued)

(56) References Cited

U.S. PATENT DOCUMENTS 5,149,977 A * 9/1992 Mita ..... H04N 1/00002 250/556
5,912,448 A 6/1999 Sevier et al.
(Continued)

FOREIGN PATENT DOCUMENTS

CN 1329546 1/2002
CN 101125496 2/2008
(Continued)

OTHER PUBLICATIONS

"Toshiba TEC Printer FAQs", Century System, Inc., Sep. 2, 2008, 11 pages. Retrieved online Mar. 25, 2015. <http://www.centurysystems.com/support/faqs/toshiba-tec-printer-faqs>.

*Primary Examiner* — Luis A Gonzalez
(74) *Attorney, Agent, or Firm* — Mannava & Kang

(57) ABSTRACT

According to an example, an apparatus to prevent media transport jams may include an actuator to load and advance a media within a media path width. The apparatus may also include a first sensor and a second sensor to detect respective edges of the media, in which the first sensor and the second sensor may be positioned outside of a media action area and on opposite sides of the media path width. The apparatus may further include a controller to prevent the actuator from advancing the media along the media path in response to a detection of one or both of the first edge of the media by the first sensor and the second edge of the media by the second sensor.

14 Claims, 7 Drawing Sheets

(52) U.S. Cl.
CPC ..... *B65H 7/20* (2013.01); *B65H 29/20* (2013.01); *B65H 2220/02* (2013.01); *B65H 2402/46* (2013.01); *B65H 2511/10* (2013.01); *B65H 2511/20* (2013.01); *B65H 2511/216* (2013.01); *B65H 2511/242* (2013.01); *B65H 2511/414* (2013.01); *B65H 2513/512* (2013.01); *B65H 2551/20* (2013.01); *B65H 2553/822* (2013.01); *B65H 2701/1315* (2013.01); *B65H 2801/03* (2013.01); *B65H 2801/12* (2013.01); *B65H 2801/39* (2013.01)

(58) Field of Classification Search
CPC ..... B65H 2511/242; B65H 2513/512; H04N 1/00718; H04N 1/00771; H04N 1/0074; H04N 1/00769; H04N 1/00745; H04N 1/00742
See application file for complete search history.

(56) References Cited

U.S. PATENT DOCUMENTS

| | | | | | |
|---|---|---|---|---|---|
| 5,918,877 | A * | 7/1999 | Takei | B65H 7/06 271/261 |
| 6,635,895 | B2 | 10/2003 | Haque et al. | |
| 7,457,012 | B2 * | 11/2008 | Fang | B65H 7/06 358/498 |
| 8,840,107 | B2 | 9/2014 | Umi et al. | |
| 2007/0242963 | A1 | 10/2007 | Saikawa et al. | |
| 2008/0187328 | A1 | 8/2008 | Schoedinger et al. | |
| 2013/0036886 | A1 | 2/2013 | Kato et al. | |
| 2013/0292899 | A1 | 11/2013 | Mattern et al. | |
| 2014/0310839 | A1 * | 10/2014 | Wickramasinghe | G01Q 30/02 850/40 |
| 2016/0303750 | A1 * | 10/2016 | Nagayama | B26D 5/005 |
| 2018/0220022 | A1 * | 8/2018 | Yoshikaie | B65H 7/02 |

FOREIGN PATENT DOCUMENTS

| | | | | |
|---|---|---|---|---|
| CN | 102190177 | | | 9/2011 |
| JP | 03211147 | A | * | 9/1991 |
| JP | 04106048 | A | * | 4/1992 |
| JP | 06025245 | U | | 4/1994 |
| JP | 06227707 | A | * | 8/1994 |
| JP | 08119492 | A | | 5/1996 |
| JP | 09301575 | A | * | 11/1997 |
| JP | 2002362782 | A | * | 12/2002 |
| JP | 2004175553 | A | | 6/2004 |

* cited by examiner

MEDIA TRANSPORT JAM PREVENTION

BACKGROUND

Media feeder devices are used in many types of machines including scanners, printers, fax machines, photocopiers, shredders, etc. Media feeder devices typically include feeder transport mechanisms to load and advance sheets of media into the machines. For instance, a feeder transport mechanism advances sheets of media so that a particular action or task may be performed on the sheets of media. For example, by advancing the sheets of media, the feeder transport mechanism permits the sheets of media to be scanned, printed, faxed, copied, or shredded by a machine.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1:
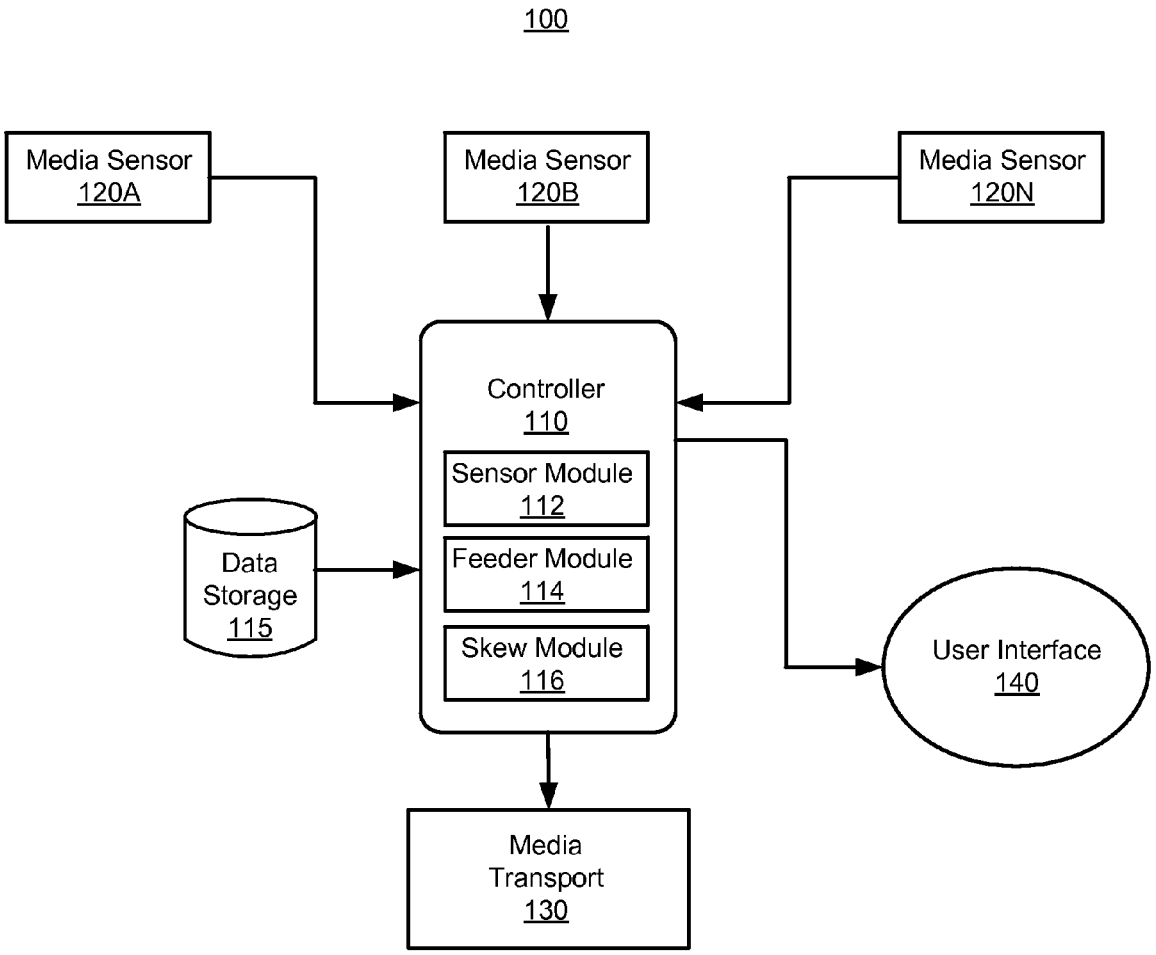
FIG. 1 shows a block diagram a block diagram of media feeder apparatus, according to an example of the present disclosure.

For simplicity and illustrative purposes, the present disclosure is described by referring mainly to an example thereof. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure. As used herein, the terms "a" and "an" are intended to denote at least one of a particular element, the term "includes" means includes but not limited to, the term "including" means including but not limited to, and the term "based on" means based at least in part on.

Disclosed herein are examples of media transport apparatuses and methods to proactively prevent occurrences of media transport jams based on feedback received from a sensor positioned within the media transport apparatuses. In various examples, feedback is received from multiple sensors in the media transport apparatuses. A media jam, for example, occurs when a sheet of media, such as paper, vellum, etc., gets stuck or lodged inside the media transport apparatus. Accordingly, the media jam may result in damaged media that is either trapped inside or output from the media transport apparatus.

According to disclosed examples, media may be loaded within a media path width of a media transport apparatus of a media feeder apparatus. The media path width, for instance, is the width of the opening of the media transport apparatus. A first sensor may be positioned outside of a media action area, in which the media action area is within the media path width. The media action area, for instance, is the width of the area of the media transport apparatus where a particular task is performed on media. For example, the media action area may be the width of one or more scan bars that are used to perform the task of scanning the media, the width that a print dispenser traverses to perform the task of printing on the media, the width of a plurality of blades that are used to perform the task of shutting the media, etc. In any case, the width of the media action area is less than the media path width according to the disclosed examples.

According to an example, when media is incorrectly loaded within the media path width of the media transport apparatus, the first sensor is positioned within the media transport apparatus to detect an edge or side border of the media and to notify a controller of the media feeder apparatus. That is, the first sensor may detect that the media has been loaded outside of the media action area by a given distance. The controller may then determine that the media has been incorrectly loaded with too much offset and prevent the media from being advanced through the document transport to proactively prevent a media jam. Offset, for instance, may refer to the media being loaded in a manner that is outside of the media action area. In this regard, the controller may instruct a user interface of the media feeder apparatus to display a message with proper media transport apparatus loading procedures for a user to reload the media into the media transport apparatus.

A second sensor may be positioned outside of the media action area within the media path width on a side opposite of the first sensor. The controller may prevent media from being advanced though the media transport apparatus due to an offset loading error for the media if one of the first sensor and second sensor detects an edge or side border of the media during the loading of the media. The controller may also prevent the media from being advanced to the media transport apparatus due to a media size error (e.g., the media sheet is too wide) if both the first sensor and the second sensor detect edges of the media during the loading of the media. In either case, the controller may instruct a user interface of the media feeder apparatus to display a message with proper procedures or guidelines for a user to reload the media into the media transport apparatus. According an example, an intermediate sensor may be positioned between the first sensor and the second sensor to detect the presence of the media in the media transport apparatus.

According to another example, the media may be advanced within the media path width of the media transport apparatus. While the media is being advanced in the media transport apparatus, at least one of the first sensor and the second sensor may detect an edge or a side border of the media, and thus, alert the controller that the advancement of the media is skewed or off-center. That is, the first sensor or the second sensor may detect that the media has been advanced outside of the media action area by a given distance. In response to the alert, the controller may calculate a skew rate to determine whether the media may be advanced further without causing a media transport jam. To calculate the skew rate, the controller may evaluate a progression distance of the advancement of a portion of the media prior to the detection of the edge of the media, assess a margin distance between the at least one of the first sensor and the second sensor and the end of the media path width; and estimate whether the margin distance permits the advancement of a remaining portion of the media without causing a media transport jam. If the estimated margin distance permits the advancement of a remaining portion of the media without causing a media transport jam, the controller may advance the remaining portion of the media through the media transport apparatus. If the estimated margin distance does not permit the advancement of a remaining portion of the media without causing a media transport jam, the controller may halt advancement of the media and display an alert to a user.

Thus, the disclosed examples may prevent common media transport jam scenarios from occurring. The disclosed examples may prevent the advancement or feeding of media or documents wider than a permitted media size, prevent the feeding of media that are loaded with too much offset from the center of the media path width, and detect skewed media during advancement to stop the advancement before a media transport jam occurs. Other media feeder apparatus react after a media transport jam occurs or prevents media transport jams through routine maintenance and publishing of user media loading instructions. Neither of these approaches, however, addresses the tendency of users to load media incorrectly into the media transport apparatus or prevents damage to the original media during a media transport jam. In this regard, the disclosed examples may provide the technical benefits of proactive sensing of unsafe media load and feed conditions to protect media originals that may be incorrectly loaded, too wide, or too skewed to be safely handled by the media transport apparatus of the media feeder apparatus.

With reference to FIG. 1, there is shown a block diagram of a media feeder apparatus 100, according to an example of the present disclosure. It should be understood that the media feeder apparatus 100 may include additional components and that one or more of the components described herein may be removed and/or modified without departing from a scope of the media feeder apparatus 100. The media feeder apparatus 100 may be implemented in a scanner, printer, photocopier, fax machine, scanner, etc. As shown, the media feeder apparatus 100 may include a controller 110, a data store 115, media sensors 120A-N (where N may be a number greater than 1), a media transport apparatus 130, and a user interface 140. Additionally, the media feeder apparatus 100 may be an automatic document feeder.

The controller 110, which may be a processor, microprocessor, micro-controller, an application specific integrated circuit (ASIC), or the like, is to perform various processing functions in the media feeder apparatus 100. The processing functions may include the functions of the sensor module 112, feeder module 114, and the skew module 116 of the controller 110.

The sensor module 112 may receive feedback or notifications from the media sensors 120A-N that the presence of media and/or a media edge have been detected. The media sensors 120A-N may include, but are not limited to optical sensors, position sensors, proximity sensors, and flags to detect the presence of media and/or a media edge. The sensor module 112, for example, may determine that the media is offset, too wide, or skewed along a media path based on the notifications of the media sensors 120A-N. The feeder module 114 may instruct the media transport apparatus 130 to advance or halt the advancement of media that has been loaded into the media transport apparatus 130. The skew module 116 may calculate a skew rate to determine whether the media may continue to be advanced without causing media transport jam. In this example, modules 112-116 are circuits implemented in hardware. In another example, the modules 112-116 may be machine readable instructions stored on a non-transitory computer readable medium and executed by the controller 110 as discussed further below.

The controller 110 may be coupled to the data store 115 and the user interface 140 by a bus (not shown). The bus may be a communication system that transfers data between various components of the media feeder apparatus 100. In examples, the bus may be a Peripheral Component Interconnect (PCI), Industry Standard Architecture (ISA), PCI-Express, HyperTransport®, NuBus, a proprietary bus, and the like. The data store 115 may include physical memory such as a hard drive, an optical drive, a flash drive, an array of drives, or any combinations thereof, and may include volatile and/or non-volatile data storage.

The media transport apparatus 130 may include an opening to receive loaded media. The media transport apparatus 130 may also include media transport rollers to advance the media along a media path. According to an example, the media transport rollers may be powered by a motor, such as an actuator. For example, the controller 110 may instruct the motor to advance or halt the advancement of the media via the media transport rollers. The user interface 140, for example, may be a display including a touchpad or a touchscreen to display messages or notifications to a user of the media feeder apparatus 100.

Figure 2:
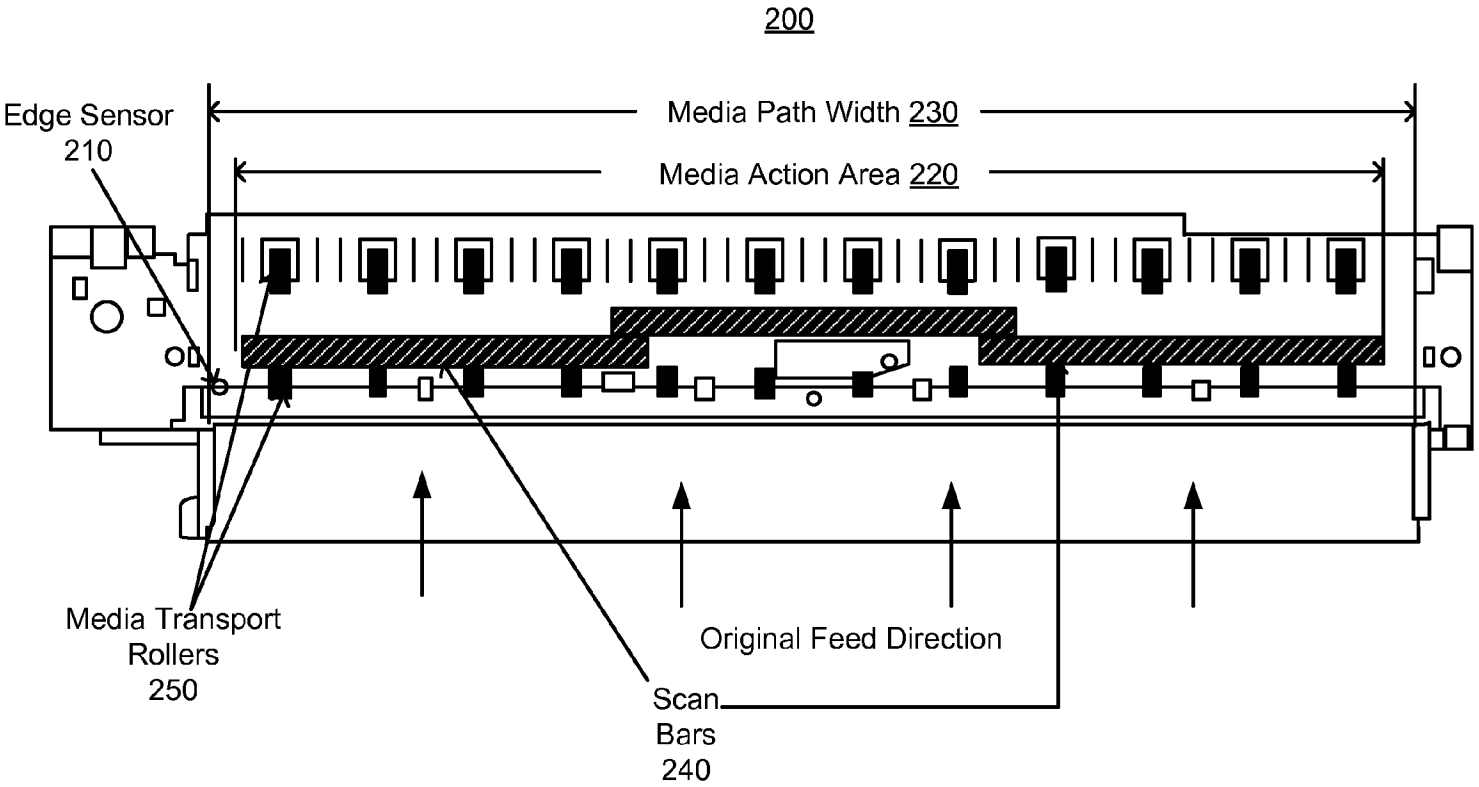
FIG. 2 shows a diagram of a media transport apparatus including an edge sensor, according to an example of the present disclosure.

FIG. 2 shows a diagram of a media transport apparatus 200 including an edge sensor, according to an example of the present disclosure. It should be understood that the media transport apparatus 200 may include additional components and that one or more of the components described herein may be removed and/or modified without departing from a scope of the media transport apparatus 200. The media transport apparatus 200 may be part of a scanner in this example, and may include an edge sensor 210, a media action area 220, a media path width 230, scan bars 240, and media transport rollers 250.

In the example of FIG. 2, the edge sensor 210 positioned outside of the media action area 220, but within the media path width 230 of the media transport apparatus 200. The media action area 220, for instance, is the width of the area of the media transport apparatus where a particular task is performed on the media. For example, the media action area 220 in FIG. 2 is the width across the scan bars 240 that are used to perform the task of scanning media. The media path width 230 may be the width of the opening of the media transport apparatus 200. The width of the media action area 220 is less than the media path width 230. The edge sensor 210 may be positioned on the left side of the media transport apparatus 200 to detect the presence of a left edge of a media. Accordingly the edge sensor 210 may detect that the media is offset or skewed to the media action area 220. The edge sensor 210 may detect the presence of an edge of the media when the media is first loaded into the media transport apparatus 200 and when the media is advanced through the media transport apparatus 200 by the media transport rollers 250 in the original feed direction shown by the directional arrows in FIG. 2. According to another example, the edge sensor 210 may also be positioned on the right side of the media transport apparatus 200 to detect the presence of a right edge of the media as described above.

Figure 3:
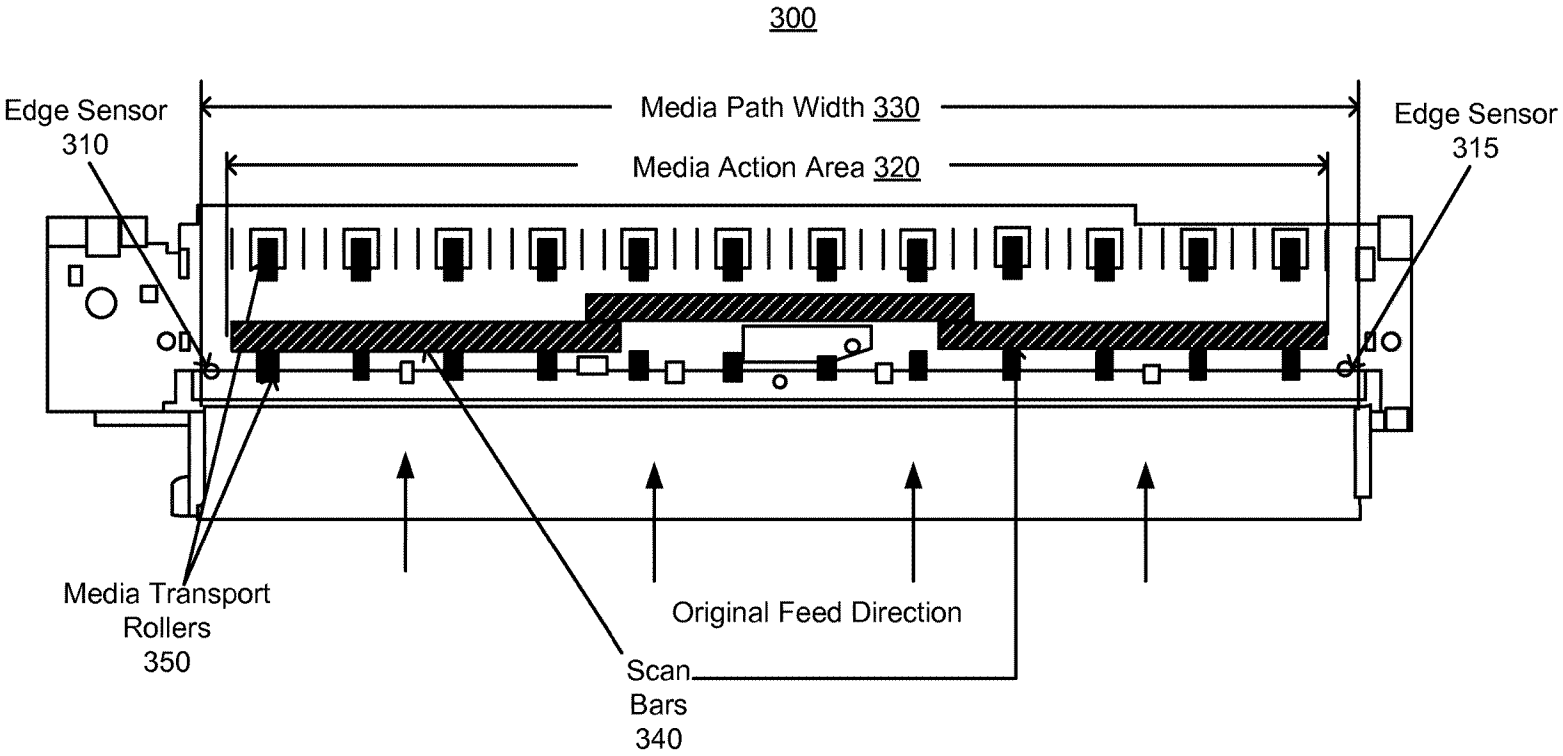
FIG. 3 shows a diagram of a media transport apparatus including two edge sensors, according to an example of the present disclosure.

FIG. 3 shows a diagram of a media transport apparatus 300 including two edge sensors, according to an example of the present disclosure. The media transport apparatus 300 may be part of a scanner in this example, and may include a first edge sensor 310, a second edge sensor 315, a media action area 320, a media path width 330, scan bars 340, and media transport rollers 350.

In the example of FIG. 3, the first edge sensor 310 and the second edge sensor 315 are positioned outside of a media action area 320 (and scan bars 340), but within the media path width 330. The first edge sensor 310 and the second edge sensor 315 are also positioned on opposite sides of the media transport apparatus 300 as shown in FIG. 3. Accordingly, the edge sensors 310 and 315 may detect the presence of either or both edges of a media when the media is first loaded into the media transport apparatus 300 and when the media is advanced through the media transport apparatus 300 by the media transport rollers 350 in the original feed direction shown by the directional arrows in FIG. 3. For example, if both the edge sensors 310 and 315 detect the presence of edges of the media, this may indicate that the media is too wide for the media action area 320.

Figure 4:
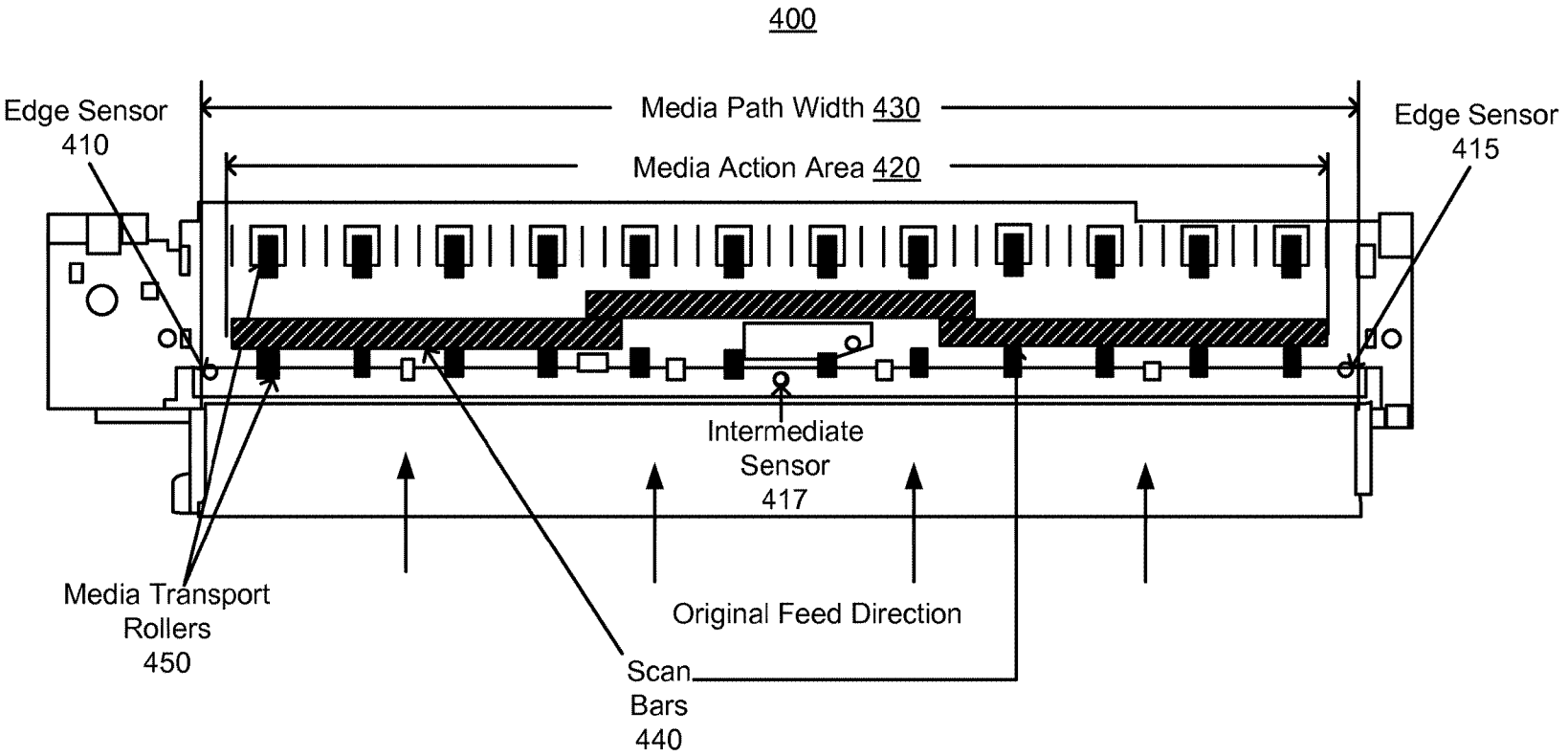
FIG. 4 shows a diagram of a media transport apparatus including two edge sensors and an intermediate sensor, according to an example of the present disclosure.

FIG. 4 shows a diagram of a media transport apparatus 400 including two edge sensors and an intermediate sensor, according to an example of the present disclosure. The media transport apparatus 400 may be part of a scanner in this example, and may include a first edge sensor 410, a second edge sensor 415, an intermediate sensor 417, a media action area 420, a media path width 430, scan bars 440, and media transport rollers 450.

In the example of FIG. 4, the intermediate sensor 417 may be positioned between the first edge sensor 410 and the second edge sensor 415 within the media action area 420 (and scan bars 440) and the media path width 430. In this regard, the intermediate sensor 417 may detect the presence of the media when the media is first loaded into the media transport apparatus 400 and when the media is advanced through the media transport apparatus 400 by the media transport rollers 450 in the original feed direction shown by the directional arrows in FIG. 4.

Figure 5:
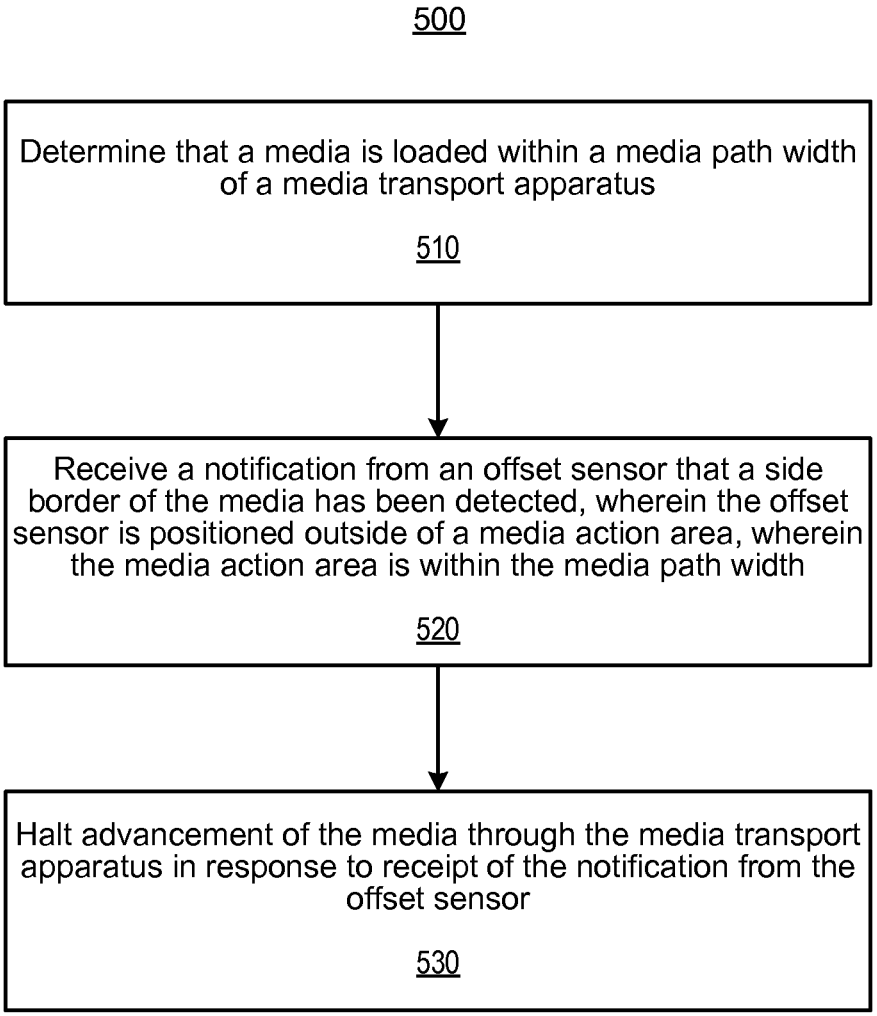
FIG. 5 shows a flow diagram of a method to prevent an occurrence of a media transport jam, according to an example of the present disclosure.
Figure 6:
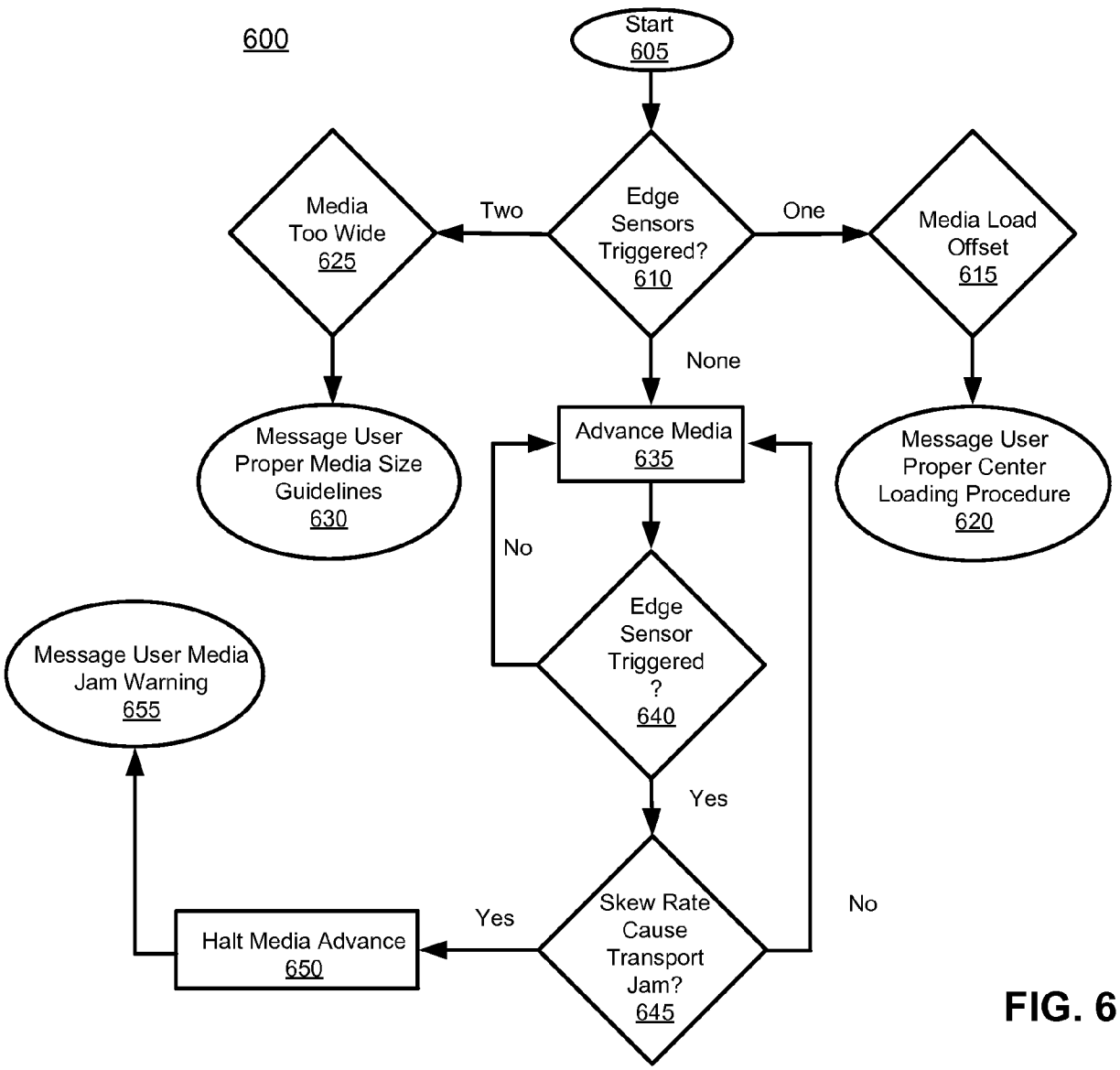
FIG. 6 shows a flow diagram of a method to prevent an occurrence of a media transport jam, according to another example of the present disclosure.

FIGS. 5 and 6 depict flow diagrams of methods 500 and 600 to prevent an occurrence of a media transport jam based on feedback received from media sensors according to examples of the present disclosure. It should be apparent to those of ordinary skill in the art that the methods 500 and 600 represent generalized illustrations and that other operations may be added or existing operations may be removed, modified or rearranged without departing from the scopes of the methods 500 and 600.

FIG. 5 shows a flow diagram of a method 500 to prevent an occurrence of a media transport jam, according to an example of the present disclosure. Method 500 may be implemented, for instance, by the controller 110 of the media feeder apparatus 100.

In block 510, the sensor module 112 of the controller 110 may determine that a media is loaded within a media path width of a media transport apparatus. In block 520, sensor module 112 may receive a notification from an offset sensor that a side border of the media has been detected. The offset sensor may be positioned outside of a media action area and the media action area may be within the media path width. Thus, the advancement of the media through the media transport apparatus may be halted in response to receipt of the notification from the offset sensor, as shown in block 530. According to an example, the controller 110 may display at least one of a message with proper media transport apparatus loading procedures for the media and an offset loading error message in response to receipt of the notification from the offset sensor. Method 500 will now be described in greater detail with reference to method 600 in FIG. 6.

FIG. 6 shows a flow diagram of a method 600 to prevent an occurrence of a media transport jam, according to another example of the present disclosure. Method 600 may be implemented, for instance, by the controller 110 of the media feeder apparatus 100.

In block 605, the sensor module 112 of controller 110 may detect that media has been loaded into a media path width of a media transport apparatus. For example, the sensor module 112 may detect that the media has been loaded in response to feedback received from an intermediate sensor. The intermediate sensor may be positioned in between a media action area and in between a first edge sensor and a second edge sensor as discussed further below. Accordingly, the intermediate sensor may detect the presence of the media due to its position within the media path width of the media transport apparatus.

Once the loading of the media has been detected, the sensor module 112 may determine whether the media is loaded correctly into the media transport apparatus based on whether one or both of the first edge sensor and the second edge sensor are triggered in response to detecting the presence of an edge of the media. According to an example, the first edge sensor and the second edge sensor are positioned outside of a media action area and on opposite sides within the media path width. As a result, the first edge sensor and the second edge sensor may detect the presence of opposite edges of the media.

In response to one of the first edge sensor and the second edge sensor detecting an edge of the media, the sensor module 112 may determine that the media was loaded incorrectly due to an offset, as shown in block 615. Thus, the feeder module 114 does not advance the media through the media transport apparatus, and the sensor module 112 may instruct a user interface of the media feeder apparatus to display a message with proper center loading procedures for the user, as shown in block 620.

In response to both of the first edge sensor and the second edge sensor detecting opposite edges of the media, the sensor module 112 may determine that the media was loaded incorrectly because the media is too wide for the media action area, as shown in block 625. Thus, the feeder module 114 may does advance the media through the media transport apparatus, and the sensor module 112 may instruct a user interface of the media feeder apparatus to display a message with proper media size guidelines for the user, as shown in block 630.

If none of the edge sensors are triggered in block 610, the feeder module 114 may advance the media within the media path width of the media transport apparatus, as shown in block 635. During the advancement of the media, the sensor module 112 may determine if that at least one of the first edge sensor and a second edge sensor detects an edge of the media. If none of the edge sensors are triggered, the feeder module 114 may continue to advance the media as shown in block 635.

However, if the sensor module 112 determines that at least one of the edge sensors are triggered, then the skew module 116 may calculate a skew rate for the advancement of the media as shown in block 645. The skew rate, for instance, is calculated to determine whether the media can be further advanced without causing a media transport jam.

According to an example, the skew rate is calculated by evaluating a progression distance of the advancement of a portion of the media prior to the detection of the edge of the media by the triggered edge sensor and assessing a margin distance between the triggered edge sensor the end of the media path width. Based on the progression distance in the margin distance, the skew module 116 may accurately estimate whether the margin distance permits the advancement of a remaining portion of the media without causing a media transport jam.

In this regard, if the skew module 116 determines in block 645 that a media transport jam will not occur based on the calculated skew rate, then the feeder module 114 may continue the advancement of the remaining portion of the media, as shown in block 635. On the other hand, if the skew module 116 determines in block 645 that a media transport jam will occur based on the calculated skew rate, the feeder module 114 may halt the advancement of the media as shown in block 650 and the skew module 116 may instruct the user interface of the media feeder apparatus to display a message alerting the user of a potential media transport jam, as shown in block 655.

Some or all of the operations set forth in the methods 500 and 600 may be contained as utilities, programs, or subprograms, in any desired computer accessible medium. In addition, methods 500 and 600 may be embodied by computer programs, which may exist in a variety of forms both active and inactive. For example, they may exist as machine readable instructions, including source code, object code, executable code or other formats. Any of the above may be embodied on a non-transitory computer readable storage medium.

Examples of non-transitory computer readable storage media include computer system RAM, ROM, EPROM, EEPROM, and magnetic or optical disks or tapes. It is therefore to be understood that any electronic device capable of executing the above-described functions may perform those functions enumerated above.

Figure 7:
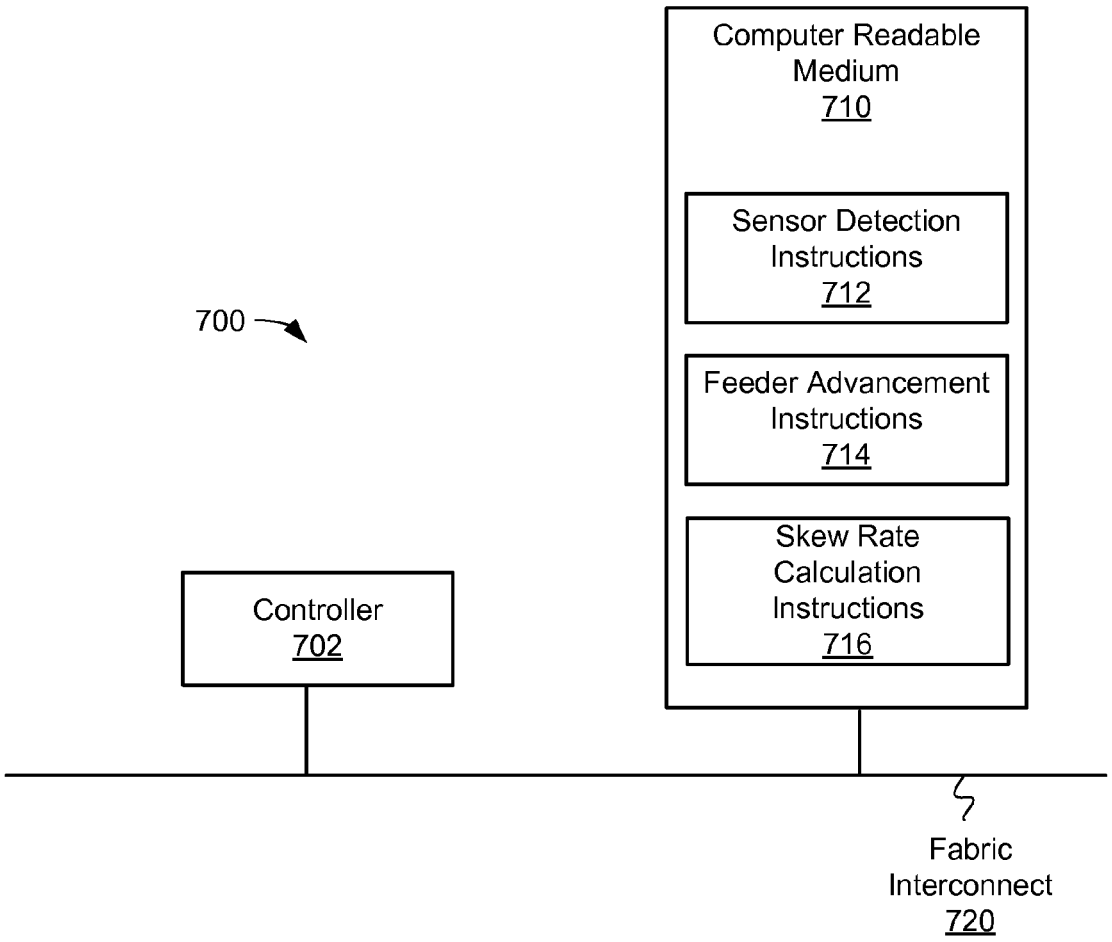
FIG. 7 shows a schematic representation of a computing device, which may be employed to perform various functions of a controller, according to an example of the present disclosure.

Turning now to FIG. 7, a schematic representation of a computing device 700, which may be employed to perform various functions of the modules 112-116, is shown according to an example implementation. The device 700 may include a controller 702 coupled to a computer-readable medium 710 by a fabric interconnect 720. The computer readable medium 710 may be any suitable medium that participates in providing instructions to the controller 702 for execution. For example, the computer readable medium 710 may be non-volatile media, such as an optical or a magnetic disk; volatile media, such as memory.

The computer-readable medium 710 may store instructions to perform methods 500 and 600. For example, the computer-readable medium 710 may include machine readable instructions such as sensor detection instructions 712 to determine whether at least one edge sensor detects an edge of media during the loading or advancement the media, feeder advancement instructions 714 to advance media that is loaded within a media path width of the media transport apparatus, and skew rate calculation instructions 716 to calculate a skew rate for the advancement of the media. Accordingly, the computer-readable medium 710 may include machine readable instructions to perform methods 500 and 600 when executed by the controller 702.

What has been described and illustrated herein are examples of the disclosure along with some variations. The terms, descriptions and figures used herein are set forth by way of illustration only and are not meant as limitations. Many variations are possible within the scope of the disclosure, which is intended to be defined by the following claims—and their equivalents—in which all terms are meant in their broadest reasonable sense unless otherwise indicated.

What is claimed is:

1. An apparatus to prevent media transport jams, comprising:

an actuator to advance a media within a media path width;

a first sensor to detect a first edge of the media;

a second sensor to detect a second edge of the media, wherein the first sensor and the second sensor are positioned outside of a media action area and on opposite sides of the media path width, wherein the media action area is positioned within the media path width;

an intermediate sensor positioned between the first sensor and the second sensor to detect a presence of the media; and a controller to:

calculate a progression distance of the advancement of a portion of the media prior to detection by the first sensor of the first edge or by the second sensor of the second edge of the media based on the detection of the presence of the media by the intermediate sensor and a measured distance that the media traveled prior detection by the first sensor or the second sensor of the media;

assess a margin distance between the first sensor and a first end of the media path width or between the second sensor and a second end of the media path width; and estimate, based on the progression distance of the portion of the media and the assessed margin distance, whether the assessed margin distance permits the advancement of a remaining portion of the media without causing a media transport jam.

2. The apparatus of claim 1, wherein responsive to the detection of one of the first edge of the media and the second edge of the media, the controller is to determine that an offset loading error of the media has occurred.

3. The apparatus of claim 2, further comprising:

a user interface;

wherein the controller is to display a message on the user interface with proper media loading procedures responsive to the determination that the offset loading error has occurred.

4. The apparatus of claim 1, wherein responsive to the detection of both the first edge of the media and the second edge of the media, the controller is to determine that a wide media size error of the media has occurred.

5. The apparatus of claim 4, further comprising:

a display;

wherein the controller is to display a message on the display with media size guidelines responsive to the determination that the wide media size error has occurred.

6. The apparatus of claim 1, wherein the apparatus is a document feeder.

7. The apparatus of claim 1, wherein the apparatus is a machine selected from the group consisting essentially of a scanner, printer, photocopier, facsimile machine, and shredder.

8. A method to prevent media transport jams, comprising:

determining, by a controller, based on a detection of a presence of a media by an intermediate sensor that the media is loaded within a media path width of a media transport apparatus;

determining, by the controller, a progression distance of an advancement of a portion of the media as the media is advanced along the media path based on the detection of the presence of the media by the intermediate sensor and a measured distance that the media traveled;

receiving, by the controller, a notification from an offset sensor that a side border of the media has been detected, wherein the offset sensor is positioned outside of a media action area, wherein the media action area is within the media path width;

calculating, by the controller, the progression distance of the advancement of the portion of the media when the notification is received based on a measured distance that the media traveled when the notification is received;

assessing, by the controller, a margin distance between the offset sensor and an end of the media path width;

estimating, by the controller, based on the calculated progression distance of the portion of the media and the assessed margin distance, whether the assessed margin distance permits the advancement of a remaining portion of the media without causing a media transport jam; and based on an estimation that the assessed margin distance does not permit the advancement of the remaining portion of the media without causing the media jam, halting, by the controller, advancement of the media through the media transport apparatus.

9. The method of claim 8, further comprising:

displaying at least one of a message with proper media transport apparatus loading procedures for the media and an offset loading error message in response to receipt of the notification from the offset sensor.

10. The method of claim 8, wherein the media action area comprises an area within the media path width over which an action is performed on the media.

11. An apparatus to prevent media transport jams, comprising an actuator to advance media that is loaded within a media path width of a media transport apparatus;

at least one of a first sensor and a second sensor to detect an edge of the media during the advancement of the media, wherein the at least one of the first sensor and the second sensor is positioned outside of a media action area, wherein the media action area is positioned within the media path width;

an intermediate sensor positioned between the first sensor and the second sensor to detect a presence of the media; and a controller to:

determine a progression distance of an advancement of a portion of the media as the media is advanced along the media path based on the detection of the presence of the media by the intermediate sensor and a measured distance that the media traveled prior detection by the first sensor or the second sensor of the media;

receive a notification from the first sensor or the second sensor that a side border of the media has been detected;

calculate the progression distance of the advancement of the portion of the media when the notification is received;

assess a margin distance between the first sensor and a first end of the media path width or the second sensor and a second end of the media path width;

estimate, based on the calculated progression distance of the portion of the media and the assessed margin distance, whether the assessed margin distance permits the advancement of a remaining portion of the media without causing a media transport jam.

12. The apparatus of claim 11, wherein to calculate the skew rate, the controller is to:

display at least one of a message with proper media transport apparatus loading procedures for the media and an offset loading error message in response to receipt of the notification from the first sensor or the second sensor.

13. The apparatus of claim 11, wherein responsive to an estimation that the assessed margin distance permits the advancement of the remaining portion of the media without causing a media jam, the controller is to advance the remaining portion of the media through the media transport apparatus.

14. The apparatus of claim 11, wherein responsive to estimating an estimation that the margin distance does not permit the remaining portion of the media to be advanced without causing a media jam, the controller is to:

halt the advancement of the media; and display an alert of a prospective media transport jam and instructions for preventing the prospective media transport jam.

* * * * *